United States Patent [19]

Inniger

[11] Patent Number: 4,772,018

[45] Date of Patent: Sep. 20, 1988

[54] CORNER TABLE TENNIS

[76] Inventor: Ronnie R. Inniger, 1120 Glendale Rd., Richmond, Ind. 47374

[21] Appl. No.: 71,837

[22] Filed: Jul. 10, 1987

[51] Int. Cl.[4] ..... A63B 67/04

[52] U.S. Cl. ..... 273/30; 108/64

[58] Field of Search ..... 273/30; 108/11, 13, 108/17, 97, 111, 153, 64, 65, 59

[56] References Cited

U.S. PATENT DOCUMENTS

| | | | |
|---|---|---|---|
| 2,174,884 | 10/1939 | Kachel | 273/30 |
| 2,313,701 | 3/1943 | White | 273/30 |
| 2,333,098 | 11/1943 | Forsyth | 273/30 |
| 2,781,194 | 2/1957 | Sistrunk | 273/30 |
| 2,836,475 | 5/1958 | Sapp | 108/64 |
| 3,053,598 | 9/1962 | Cheslow | 108/64 |
| 3,133,734 | 5/1964 | Latham | 273/30 |
| 3,741,852 | 6/1973 | Keener | 108/64 |
| 3,891,210 | 6/1975 | Van Horne | 273/30 |
| 4,282,817 | 8/1981 | Gutterman | 108/11 |
| 4,334,681 | 6/1982 | Scheie . | |
| 4,675,929 | 6/1987 | Santo | 108/64 |

*Primary Examiner*—Leo P. Picard
*Assistant Examiner*—Brown: T.
*Attorney, Agent, or Firm*—Biebel, French & Nauman

[57] ABSTRACT

This game apparatus includes a playing surface having end sections mounted at right angles to each other, thus forming a corner with a center section positioned between the end sections, a backboard mounted along the outer edges of the playing surface, panels mounted along the inside edges of the playing surface and a net extending from the corner to the backboard. The rules of the game require that the ball come in contact with the playing surface, backboard and panels in a specified order both while serving and during play. The game apparatus fits easily into a corner of a room and the game requires utilization of very little space around the game apparatus.

7 Claims, 2 Drawing Sheets

CORNER TABLE TENNIS

BACKGROUND OF THE INVENTION

This invention relates to a table tennis game and, more particularly, to a game which is played with equipment that can fit in a small area and which requires special skills not required in ordinary table tennis games.

Table tennis games have been popular for many years, particularly among persons who want the thrill of competition but do not want the exercise associated with the game of tennis. However, a disadvantage of the presently available table tennis games is that they are played with equipment that requires large areas of play and are therefore unavailable to persons with a limited play area.

Another disadvantage of the presently available table tennis game is that, because none of the playing surface is enclosed, the entire area around the court must be utilized by the players in order to maintain control of the ball. This, of course, requires a large area of play, usually in the center of a room, and therefore the play area cannot be utilized for other purposes when the game apparatus is assembled or when the game is being played.

There are also presently available other table games, such as ball return games, which are played with equipment that requires a small area of play such as the present invention requires. However, these games are ordinarily either played by one person, therefore lacking the thrill of competition or, even if played by more than one person, do not require a high level of skill or dexterity. Therefore, many persons become easily bored and quickly lose interest in playing these games.

What is needed, therefore, is a table tennis game which can be played in a relatively small area so that it is available to most people but which will also require a high level of dexterity and skill. Such a game should attract the interest of those persons who are easily bored with the presently available table tennis and other table games and the interest of those persons who enjoy table tennis but have a limited area in which to play.

SUMMARY OF THE INVENTION

The present invention discloses a game apparatus for playing a table tennis game including a playing surface with three sections, with the end sections joining each other at right angles to form an inner corner and with the middle section being positioned between the two end sections. These sections are connected so that the sections are collapsible for the purposes of storage. The playing surface is supported by folding metal legs of a height which allows the playing surface to be disposed at normal table height.

A backboard with three portions is mounted in an upright position with the center portion of the backboard positioned directly across from the inner corner of the playing surface. The backboard extends along at least part of the outer edges of the end playing sections and is positioned so that 45° angles are formed at the intersection of the center and side portions of the backboard. The backboard is mounted to the playing surface so that it is collapsible.

A net extends across the center of the middle section of the playing surface from the inner corner of the playing surface to the center of the center portion of the backboard and this net is secured to the playing surface in a manner which provides for the net to be easily removed. A pair of panels are mounted in an upright position along at least part of the inner edges of the end playing sections and are joined at the inner corner of the playing surface. The panels are mounted to the playing surface so that they are collapsible.

The game structure is adapted to allow a player to stand at the open end of each end playing section. In normal play, the ball, when served, must first hit the player's end playing section, cross the net, hit the center portion of the backboard and then hit the opposing player's end playing section. The ball must not hit any other walls on the server's side during the serve but may hit the opponent's side walls. During play, the ball may hit as many walls as possible but must hit the center section of the backboard before hitting the opponent's end playing section and may bounce only once on the playing surface each time it crosses the net. Compliance with the rules of the game requires a higher level of skill and dexterity than the ordinary table tennis and other table games.

By removing the panels from the inner edges of the end playing sections, four persons may play the game with the same playing rules. When two persons are playing, the panels should be in position to create a barrier to prevent the ball from leaving the court. With four players this is not necessary.

Typically, the game apparatus will be assembled in a corner of a room. However, regardless of where the game is played, there is no need for the players to use any space around the court except for the space outside the end playing sections. Thus, the game structure does not interfere with use of the play area for other purposes.

The playing surface and the backboard are typically comprised of three-quarter inch plywood and the panels are comprised of a transparent sheeting material. The backboard portions and playing surface sections are all connected so that they are easily collapsible and can be folded and stored in a small area. The playing surface is supported by metal folding legs which can also be folded and stored with the playing surface.

The object of this invention is to provide a game which can be played in a small area, typically a corner of a room, and which can be played with equipment which is easily taken apart and stored. Additionally, the object of this invention is to create a game which is exciting and interesting because of the competitive aspect and because of the level of skill and dexterity required to play.

Other objects and advantages of the invention will be apparent from the following description, the accompanying drawings and the appended claims.

DETAILED DESCRIPTION OF THE PREFERRED EMBODIMENT

Figure 1:
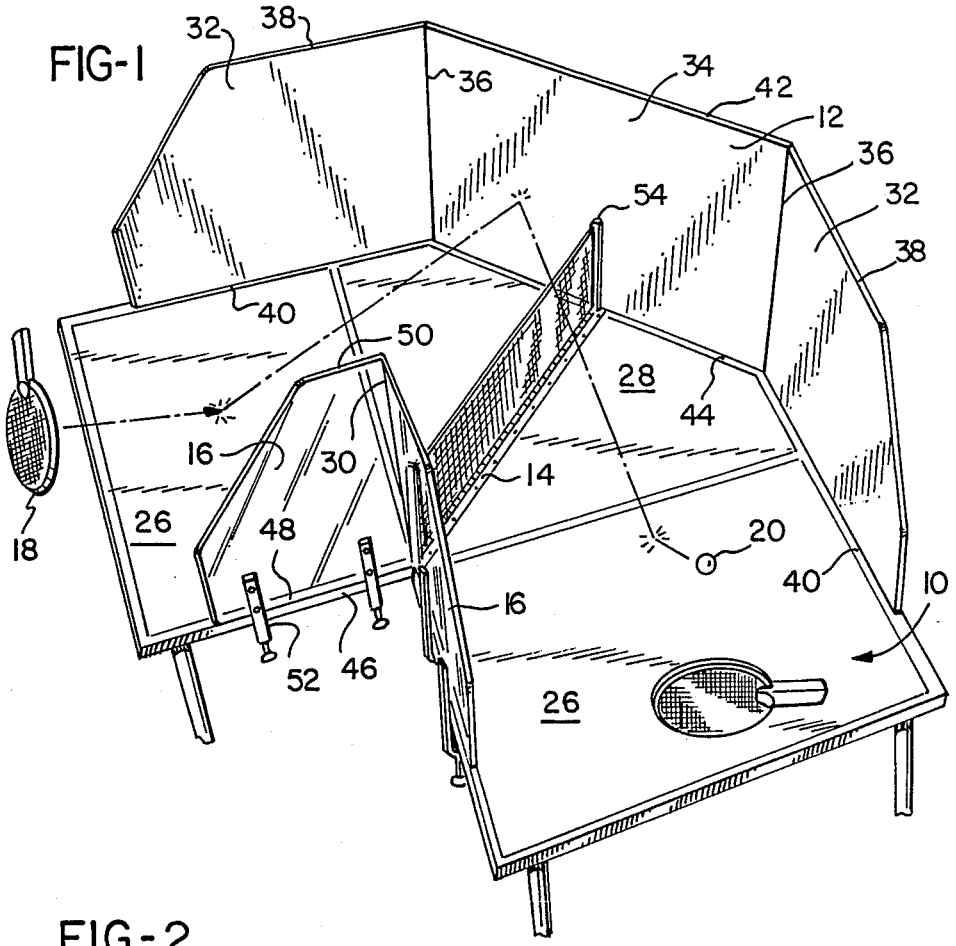
FIG. 1 is a perspective view of the game and the path which the ball takes during play.
Figure 2:
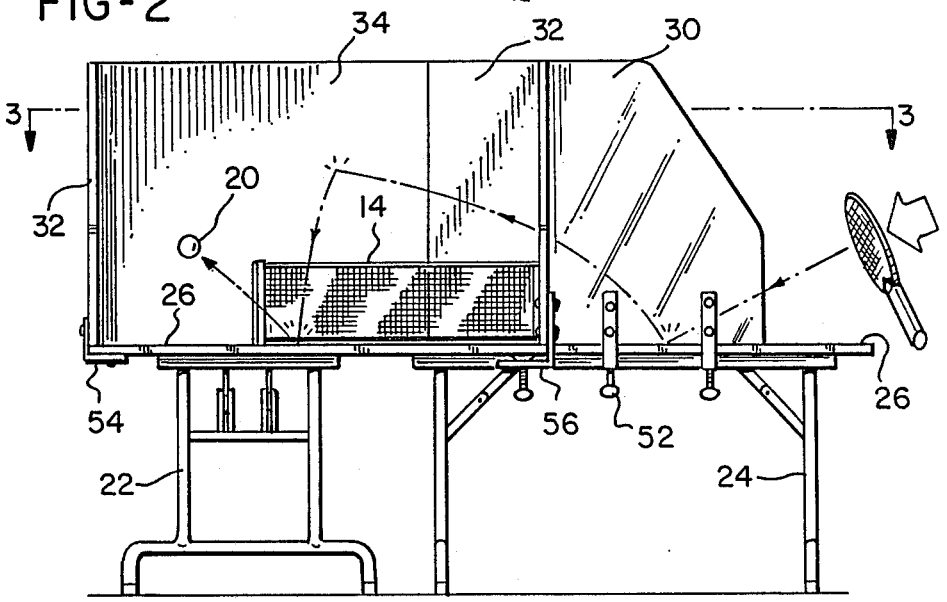
FIG. 2 is a side view of the game.
Figure 3:
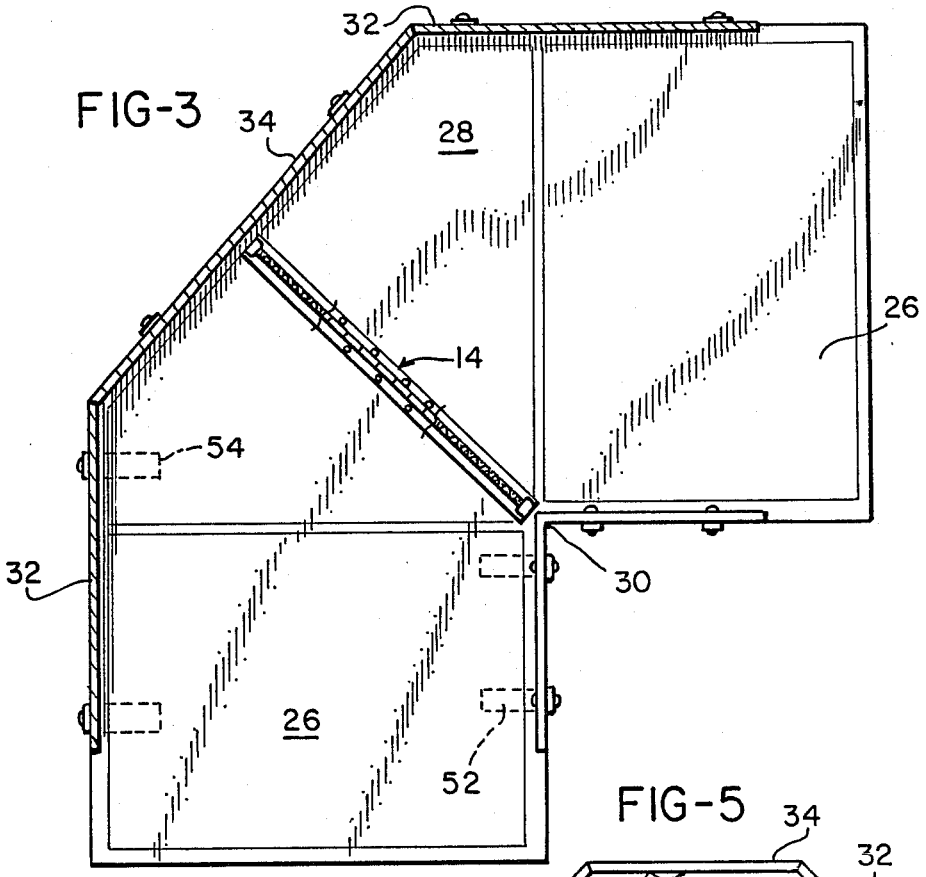
FIG. 3 is an elevational view of the playing surface showing the size and dimensions of the playing surface and the backboard.

As shown in FIGS. 1 and 3, the game apparatus includes a horizontal planar playing surface 10, a vertical backboard 12, a net 14, and vertical transparent panels 16. For the purpose of illustration, paddles 18 and a ball 20 are also shown. As shown in FIG. 2, the playing surface is preferably supported by folding metal legs 22 and collapsible metal legs 24, although fixed legs or other supports may be used.

The playing surface 10 has two end sections 26, and one middle section 28. The end sections 26 are each rectangular in shape and preferably of the same size. They are connected at right angles to each other to form an inner common corner 30. The co-planar middle section 28 can be pentagonal, rectangular or square in shape and is positioned in the space between the end sections 26. The sections are connected in such a way that they are collapsible for easy assembling and storage. The means of connecting the sections comprise 40 inch brass piano hinges or any other means which render the sections collapsible.

The vertical backboard 12 has two side portions 32 and one center portion 34. As shown in FIG. 1, the side backboard portions 32 are mounted along part of the outer edge of the end playing sections 26 and part of the outer edge of the middle playing section 28. The center backboard portion 34 is positioned between the side backboard portions 32 and is mounted across the middle playing section 28 directly across from the inner corner 30.

As shown in FIG. 1, the side backboard portions 32 of the backboard 12 are preferably 30 inches high at the intersection 36 between the side backboard portions 32 and the center backboard portion 34, have a top edge 38 extending horizontally for a length of approximately 23½ inches in a straight line then extending outwardly and vertically for approximately 22 inches and then extending vertically in a straight line for another 12 inches so that the bottom edge 40 of the end backboard portions measures approximately 36 inches. Preferably the top edge 42 and the bottom edge 44 of the center backboard portion are each approximately 47½ inches long and the center backboard portion 34 has a height of approximately 30 inches at the point of intersection 36 with the side backboard portions 32.

The playing surface 10 and the backboard 12 are preferably constructed of three-quarter inch plywood but may also be constructed of material which will create an adequate planar playing surface for playing table tennis.

The transparent panels 16 are made of a transparent sheeting material, preferably Plexiglass. They are mounted along the inner edges 46 of the end playing sections 26 and are joined at the inner corner 30 of the playing surface 10. The panels 16 preferably have a bottom edge 48 of approximately 24 inches extending from the inner corner 30 along the inner edges 46 of the end playing sections 26. The top edges 50 of the panels are preferably 30 inches high at the inner corner 30 where they intersect and have top edges 50 extending horizontally for approximately 12 inches in a straight line and then extending vertically and outwardly for approximately 22 inches and then extending in a vertical straight line for approximately 12 inches. The panels 16 are mounted to the playing surface 10 with Plexiglas hinges 52 measuring one inch by three-quarter inch but may also be mounted with any means which allow the panels 16 to be easily removed and stored. The backboard portions are connected preferably with 29 inch brass piano hinges but may also be connected with any means which allow them to be collapsible and easily removed from the table. The backboard 12 is mounted with hinges 54 as shown in FIG. 3 or with any means which allows the backboard 12 to be collapsible and easily removed from the playing surface 10.

A net 14 extends across the middle section 28 of the playing surface 10 from the inner corner 30 to the center 54 of the center backboard portion 34. The net 14 is preferably 6 inches times 38¾ inches and is secured to the table through brackets 56, as shown in FIG. 2, or any other means which allow the net to be easily assembled and removed.

Figure 4:
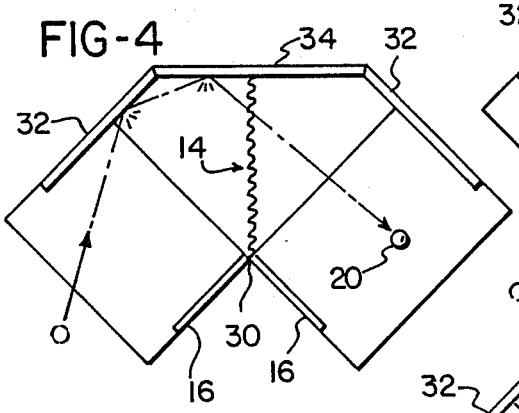
FIG. 4 is a view showing one variation of play.
Figure 5:
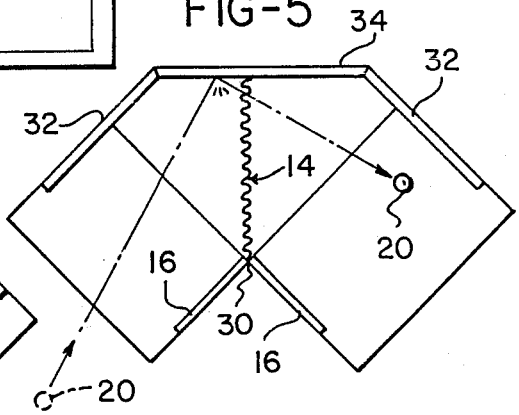
FIG. 5 shows another variation of play.
Figure 6:
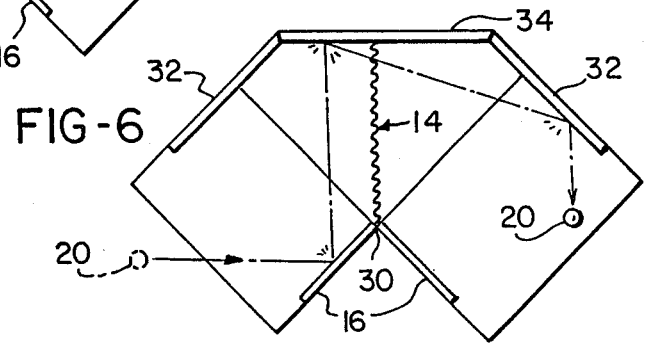
FIG. 6 shows another variation of play.

As shown in FIG. 1, the rules of the game require that, with a paddle 18, a server hits the ball 20 on his end playing section, then the ball must cross the net 14, hit the center backboard portion 34 then hit the end playing section 26 of the opposing player. If the ball hits the side backboard section 32 on the server's side first as shown in FIG. 4, the player loses his serve. The ball on the serve may hit any portion of the back wall, provided it has not made contact with either panel 16 or backboard section 32. If the ball hits the side backboard section 32 on the server's side before it crosses the net 14 as shown in FIG. 6, the player loses his serve. To get the ball over the net 14 before it hits either the panel 16, or the side backboard section 32 requires great dexterity and therefore the game is exciting and competitive.

During play, the ball may hit as many walls as possible but must hit the center backboard section 34 before hitting the opponent's main playing court. The ball may bounce only once on the main playing court each time it crosses the net 14. After the serve and play has started, the ball must hit the center backboard section 34 or the player loses his volley. If the ball goes off the end without touching the playing surface but hits the player's paddle 18, the ball 20 remains in play. The ball may be played in mid-air over the playing surface and does not have to hit the playing surface at any time as long as it hits the center backboard section 34 during each volley.

If the server wins the volley, he receives one point and continues to serve. If the opponent wins the volley he receives no points but becomes the server. When one player has reached eight points, the players change sides and play continues with the same server with the players remaining at those positions until the game is over. The game is over when one player reaches fifteen points with a two-point advantage.

The panels 16 create a barrier to prevent the ball 20 from leaving the court during the course of play, thus allowing the players to remain in the open end 56 of the end playing sections 26. Therefore, it is not necessary to have a large area in which to play since the player does not have to maneuver around the entire table in order to control the ball 20. When four players play, two at each end playing section 26, the panels 16 are removed in order to give the players more room to maneuver and to add a more competitive aspect to the game. In a doubles game, the players do not alternate hits but alternate serves. Otherwise, the same rules apply as in a singles game.

While the game described and the form of apparatus for carrying this game into effect constitute preferred embodiments of this invention, it is to be understood that the invention is not limited to this precise game and form of apparatus, and that changes may be made in either without departing from the scope of the invention which is defined in the appended claims.

What is claimed is:

1. A game apparatus for playing a table tennis game comprising:

a planar playing surface having first and second rectangular end sections and a middle section, said middle section being polygonal in shape and having first and second edges at right angles to each other, said first end section having an edge thereof abutting along said first edge of said middle section and said second end section having an edge thereof abutting along said second edge of said middle section such that said first and second edges of said respective end sections joined at right angles to each other to form an inner corner therebetween;

connecting means for connecting said sections;

a backboard having first and second end portions and a center portion mounted in an upright position, said backboard first portion having a side portion extending along at least part of an edge of said first end playing section, and said backboard second portion having a side portion extending along at least part of an edge of said second end playing section, said center portion being positioned between said side backboard portions and across said middle playing section with the center of said center portion positioned directly across from said inner corner;

mounting means for mounting said backboard;

a net extending across the center of said middle playing section from said inner corner to center of said center backboard portion;

securing means for securing said net to said playing surface; and vertical supporting means for supporting said playing surface so that said playing surface is horizontally disposed at normal table height.

2. A game apparatus as claimed in claim 1 further comprising a pair of panels mounted in an upright position, one of said panels extending from said inner cornea along an edge of said first end surface in a direction away from and parallel to said second edge of said middle section and the other of said panels extending from said inner cornea along an edge of said second end surface in a direction away from and parallel to said first edge of said middle section, said panels being joined at said inner corner, and mounting means for mounting said panels to said end sections.

3. A game apparatus as claimed in claim 2 wherein said panels are comprised of a transparent sheet material.

4. A game apparatus as claimed in claim 3 wherein said center backboard portion extends for a length of approximately 47½ inches across an edge of said middle playing section opposite said inner corner and has a height of approximately 30 inches; and wherein said first and second backboard portions extend for a length of approximately 24 inches along an edge of said middle playing section and along part of an edge of respective said first and second playing sections, said first and second portions being the same height as said center portion at an edge portion thereof, the top of said first and second backboard portions extending horizontally for a length of approximately 23½ inches in a straight line, then extending outwardly and downwardly for approximately 22 inches and then extending vertically in a straight line for approximately 12 inches to said playing surface so that the bottom edges of said side backboard portions measure approximately 36 inches.

5. A game apparatus as claimed in claim 4 wherein said panels extend for a length of approximately 24 inches from said inner corner along said edge of each said end playing section and having a height of approximately 30 inches at said inner corner where said panel secitons intersect, with the top edges of said panel sections each extending horizontally for approximately 12 inches in a straight line and then extending downwardly and outwardly for approximately 22 inches then extending in a vertical straight line for approximately 12 inches to said playing surface so that the bottom edges of said panel sections have a length of approximately 24 inches.

6. A table tennis game adapted to be fitted into the corner of a room, for saving space and providing challenge to the players' skill and dexterity comprising:

a generally planar playing surface including a first generally rectangular section, a second generally rectangular section having the same size as said first section, said first and second sections being positioned with respective inside edges thereof joining at a common corner and at right angles to each other, said sections further having outside edges, said playing surface further defined by an intermediate section extending in the space between said first and second sections, said intermediate section having outside edges joining said inside edge, a generally vertically extending backboard, said backboard having a first portion extending at least partially along the outside edge of said first section and having a second portion extending at least partially along the outside edge of said playing section, and an intermediate portion forming a continuation of said first and second portions extending at 45° diagonally with respect to said first and second portions and being positioned symmetrically with respect to said intermediate playing section, and a table tennis net extending diagonally from said common corner across the surface of said intermediate playing section and terminating centrally at said intermediate backboard portion, thereby dividing said playing surface into two generally equal and right-angle oriented playing surfaces.

7. The table tennis game of claim 6 further having a generally vertically extending panel mounted on said playing surface generally along the inside edges of said first and second sections and joining in said common corner.

* * * * *